US005712455A

United States Patent [19]

Wagner

[11] Patent Number: 5,712,455

[45] Date of Patent: Jan. 27, 1998

[54] DUAL ENTRY PLUG MUFFLER

[76] Inventor: Dane Wagner, P.O. Box 211291, Anchorage, Ak. 99521

[21] Appl. No.: 609,974

[22] Filed: Feb. 29, 1996

Related U.S. Application Data

[63] Continuation-in-part of Ser. No. 254,782, Jun. 6, 1994, Pat. No. 5,496,975.

[51] Int. Cl.[6] ..... H01N 7/00

[52] U.S. Cl. ..... 181/238; 181/276; 181/282; 181/240

[58] Field of Search ..... 181/238, 239, 181/240, 249, 224, 227, 228, 264, 268, 269, 275, 276, 281, 282; 165/154; 60/322

[56] References Cited

U.S. PATENT DOCUMENTS

| | | | |
|---|---|---|---|
| 2,573,474 | 10/1951 | Marx | 181/238 |
| 2,828,830 | 4/1958 | Clark | 181/275 |
| 3,388,769 | 6/1968 | Martoia | 181/238 |
| 3,794,139 | 2/1974 | Hetherington et al. | 181/238 |
| 3,997,002 | 12/1976 | Baker et al. | 165/154 |
| 5,276,291 | 1/1994 | Norris | 181/224 |

*Primary Examiner*—Khanh Dang
*Attorney, Agent, or Firm*—Michael Tavella

[57] ABSTRACT

A muffler for exhaust systems that feed exhaust into both ends of the muffler can. Exhaust gas enters into the muffler can where it enters an exhaust gas conduit that has a center plug installed. Exhaust is fed into both ends of the exhaust gas conduit. The exhaust gas is then forced out through a number of flared holes in the exhaust gas conduit, where it enters the muffler can and exits through an exhaust port. This design creates a longer exhaust flow path, which allows the exhaust gas to cool, extending the life of the muffler. Moreover, since the gasses are unimpeded in their flow through the conduit until they hit the partition plate, the exhaust conduit is less exposed to the full heat of the exhaust gas, unlike the cones, which do not penetrate deeply into the muffler can and bear the brunt of the exhaust gas.

4 Claims, 3 Drawing Sheets

DUAL ENTRY PLUG MUFFLER

RELATED APPLICATIONS

This application is a continuation-in-part of my application Ser. No. 08/254,782, filed Jun. 6, 1994, now, U.S. Pat. No. 5,496,975.

This invention relates to plug mufflers and particularly to plug mufflers with dual entry ports for use with dual exhaust manifold airplane engines.

BACKGROUND OF THE INVENTION

The modem aircraft known as the Cessena model 185 has a manifold exhaust system that channels the exhaust from both sides of the engine into a central muffler. This muffler then vents the muffled exhaust into a single exhaust tube, where it is vented to the atmosphere. The cabin heat system also extracts the exhaust heat from this exhaust tube. The current Cessena 185 muffler system uses a baffle with perforated cones placed on each end of a muffler can. Once the exhaust has passed through the cones, it is then ducted out of the muffler. Although the cones do reduce noise, they are prone to rapid failure. The cones are placed at the inlets of the muffler where the exhaust gas is the hottest. The constant exposure to high temperature gas causes the cones to burn out quickly, which shortens muffler life and increases maintenance costs.

SUMMARY OF THE INVENTION

The present invention overcomes the burn out problem. The invention is a modification of my previous application for a plug muffler. That application is Ser. No. 08/254,782, filed Jun. 6, 1994, now U.S. Pat. No. 5,496,975. That design is a plug muffler design. I will briefly discuss the basic details of that design here. In addition, the teachings of that patent are incorporated herein by reference.

My original plug muffler design has an outer housing and an internal exhaust conduit. The exhaust conduit has a center partition that blocks the flow of exhaust gas through the conduit. A number of holes are formed through the conduit wall such that the exhaust gas passes through the holes on the inlet side of the partition and reenters the conduit on the outlet side of the partition. The holes formed in the exhaust tube of this invention have aerodynamically formed surfaces that slope smoothly. The formed surfaces both protrude above and below the exhaust tube wall. Thus, the formed surface creates an angled path for the airflow. In the original muffler design, the exhaust enters from one side of the plug muffler, exits the conduit through the holes, where the exhaust enters a sealed outer chamber that has no exit ports. The exhaust is then forced back into the conduit on the other side of the plug, and is exhausted out the outlet port.

In the instant invention, the exhaust is fed into both ends of the plugged conduit, where it is forced out through the holes. There it enters into the muffler can where it is forced out through the main exhaust port in the muffler can. Unlike the cone style mufflers, this design creates a longer exhaust flow path, which allows the exhaust gas to cool, extending the life of the muffler. Moreover, since the gasses are unimpeded in their flow through the conduit until they hit the partition plate, the exhaust conduit is less exposed to the full heat of the exhaust gas (unlike the cones, which do not penetrate deeply into the muffler can and bear the brunt of the exhaust gas).

It is an object of this invention to produce a double inlet plug muffler that improves the airflow through the muffler, while still meeting the required attenuation limits promulgated by the Federal Aviation Administration and the Environmental Protection Agency.

It is another object of this invention to produce a double inlet plug muffler that extends the life of the muffler by eliminating cones that are exposed to high temperature exhaust gas.

It is yet another object of this invention to produce a double inlet plug muffler that uses a plugged exhaust gas conduit to reduce the number of parts in the construction of the muffler.

DETAILED DESCRIPTION OF THE INVENTION

Figure 1:
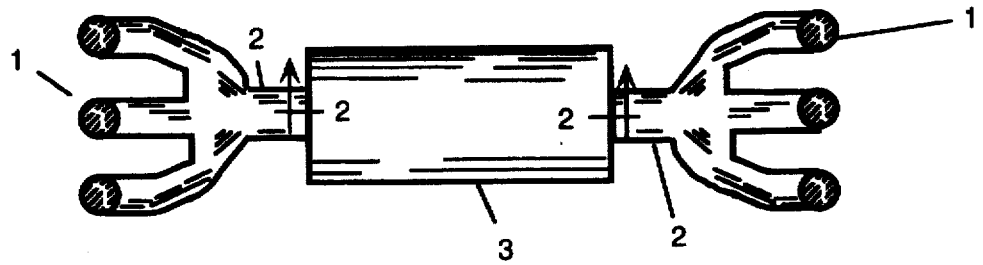
Figure 1 Prior Art
FIG. 1 is a top diagrammatic view of the exhaust system of a typical Cessena 185 as prior art.
Figure 2:
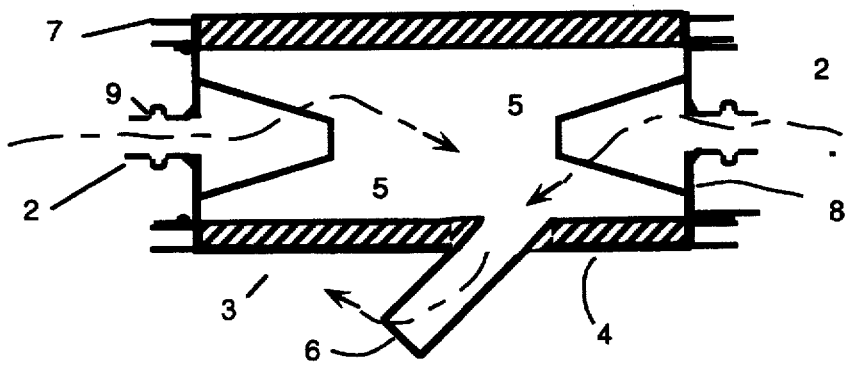
Figure 2 Prior Art
FIG. 2 is a cross sectional view, taken along the lines 2—2 of one type of prior art muffler.
Figure 3:
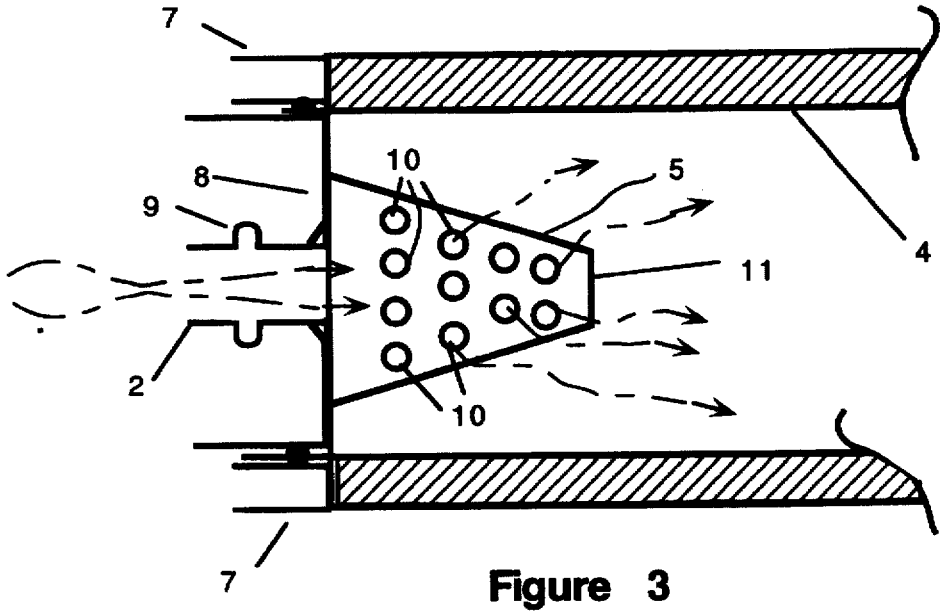
Figure 3 Prior Art
FIG. 3 is a detail view of the one end of the muffler shown in FIG. 2 as prior art.

Referring now to FIG. 1, a typical Cessena model 185 airplane engine has dual exhaust manifolds 1 that capture engine exhaust. Unlike other airplane engines that have two separate exhaust systems (mufflers and exhaust pipes), the exhaust of the Cessena 185 is collected into two exhaust lines 2 that feed into a single muffler 3. FIG. 2 shows a cross section of a common type of muffler 3 used for the Cessena 185. This muffler 3 has an outer can 4 and two cones 5 that are installed inside the outer can 4. An exit port 6 is provided as shown, to allow the exhaust gasses to leave the muffler 3. FIG. 3 is a detail of one end of the muffler 3. The outer can 4 is shown surrounding the cones 5. An exhaust shroud ring 7 is welded around the end of the outer can 4. An end plate 8 is also welded to each end of the outer can 4 as shown. The exhaust lines 2 connect to the muffler 3 using bead locks 9 as shown. This construction is common to the art. The cones 5 have a number of holes 10 to permit the exhaust gasses to exit into the muffler 3. The end 11 of the cones 5 are sealed.

Figure 4:
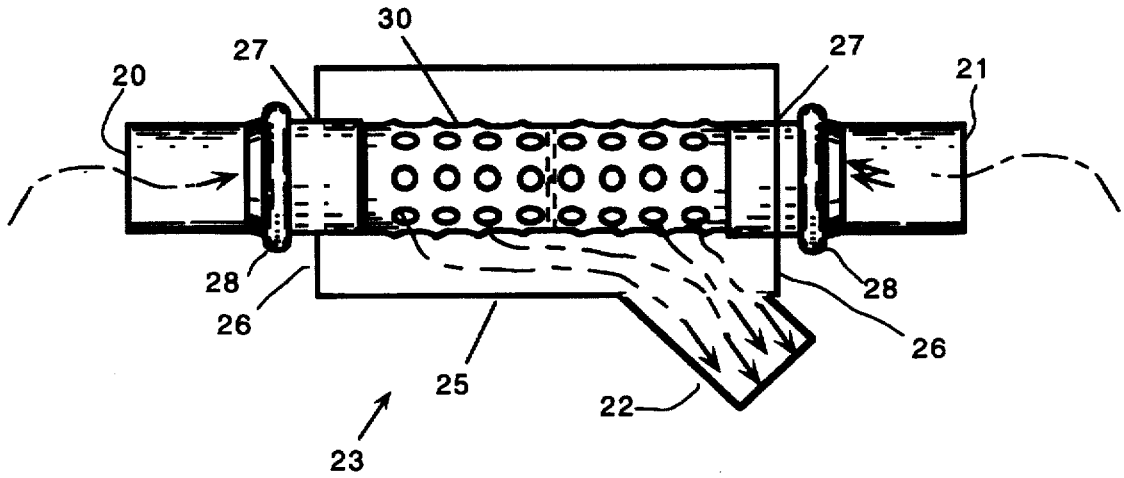
FIG. 4 is an interior view of the invention showing the exhaust conduit in place.
Figure 5:
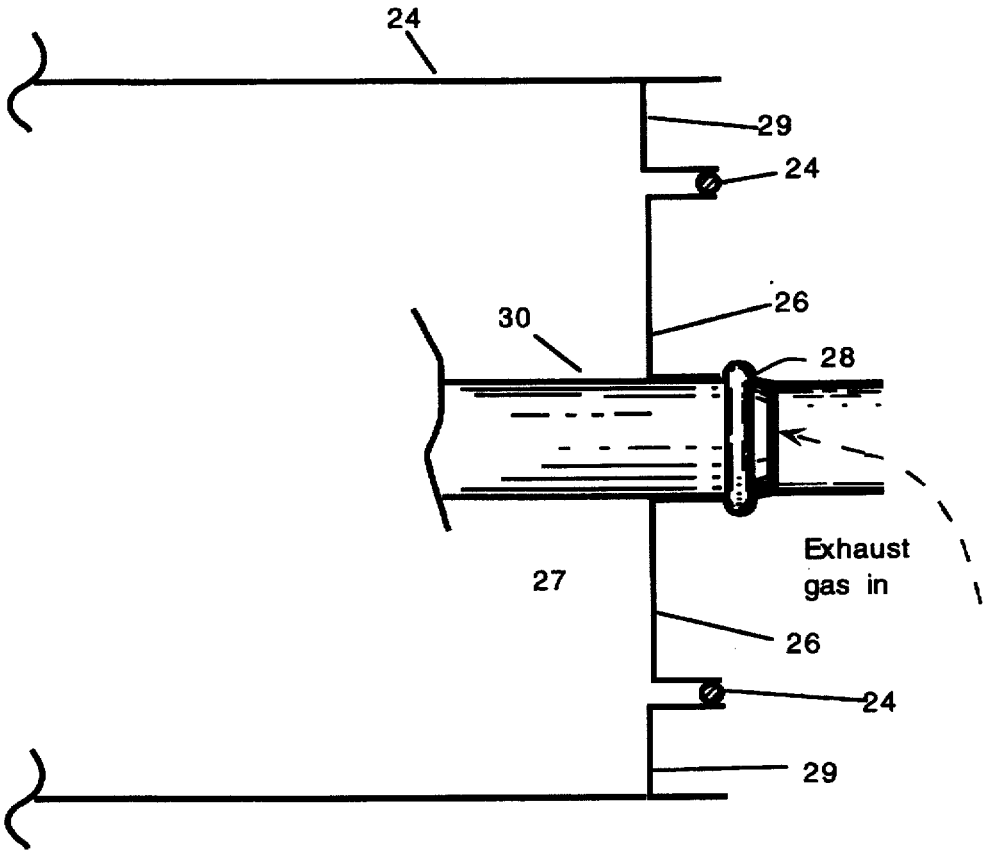
FIG. 5 is a detail view of the muffler can end in the instant invention.

FIG. 4 shows a side view of the instant invention. In this design, the outer can 4, end plates 8, and exhaust shroud ring 7 are basically the same as in the prior art. I will discuss this design in detail, using a second set of reference numerals for clarity. The instant muffler system has a first inlet port 20 and a second inlet port 21 and an exhaust port 22. The muffler can 23 has a cylindrical housing 25. At each end of the cylindrical housing 25 is an end plate 26 that has a center opening 27 to receive a bead lock 28. An exhaust shroud 29 is welded about the end plate 26 as shown. See welds 24. FIG. 5 shows details of this construction. An exhaust gas conduit 30 is secured to the bead locks 28 within the muffler can 23 as shown.

Figure 6:
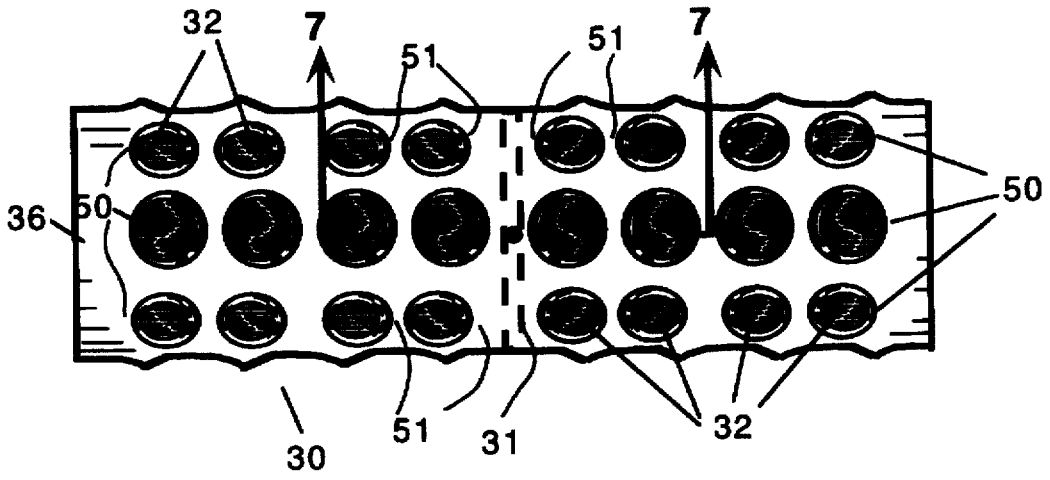
FIG. 6 is a side view of the exhaust gas conduit.
Figure 7:
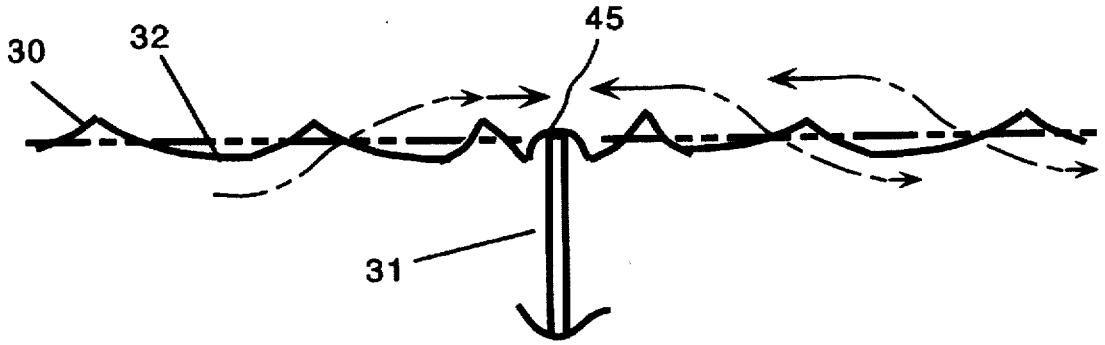
FIG. 7 is a sectional view along the lines 7—7 showing details of the formed holes and the partition plate and airflow through the exhaust gas conduit.

FIGS. 6 and 7 show details of the exhaust gas conduit 30. The exhaust gas conduit 30 has a partition plate 31 installed in its center. The partition plate 31 acts to close off the exhaust gas conduit 30 and to prevent the flow of gas through the exhaust gas conduit 30. In this design, exhaust gas enters both ends of the exhaust gas conduit 30 as shown. The exhaust gas is forced out of the holes 32, formed in wall of the exhaust gas conduit 30, because the partition plate 31 prevents through passage of the exhaust gas. Once the exhaust gas passes through holes 32, it is exhausted to the atmosphere through the exhaust port 22.

The exhaust gas conduit 30 is virtually identical to that described in my previous patent, except for the end connectors. Because the exhaust gas conduit 30 has two input ports, the ends are fitted with identical inlet port fittings, or bead locks 28, to be able to connect to the Cessena 185 exhaust manifold pipes.

The key features of the exhaust gas conduit 30 are described as follows. The exhaust gas conduit 30 is a hollow cylinder that is sized for the appropriate use. A number of holes 32 are drilled into the cylindrical wall 35 of the exhaust gas conduit 30 as shown. Each of the holes 32, has a point 50 that is closest to the bead locks 28, the exhaust gas conduit 30 and a point 51 that is closest to the partition plate 31 in the exhaust gas conduit 30 as shown in FIG. 7.

Each of the holes 32 is flared to improve the airflow through the exhaust gas conduit 30. The flares are created about the cylindrical wall 36 of the exhaust gas conduit 30. Each hole is flared by depressing the cylindrical wall downward at the point 50, closest to the bead lock 28 side of the exhaust gas conduit 30; and by raising the cylindrical wall upward at point 51 of each hole 32. See FIG. 7.

A partition plate 31 is installed within the exhaust gas conduit 30 as shown. The partition plate 31 sized to completely fit within the exhaust gas conduit 30 and to seal the interior of the exhaust gas conduit 30 to prevent the flow of exhaust through the exhaust gas conduit 30. The partition plate 31 is secured into place by welding. Besides the welds, the raised wall portions at points 51 formed in the set of holes 32 that are adjacent to the partition plate 31, act as supports for the partition plate 31 to keep it from moving or turning. To achieve this effect, the partition plate 31 must have sufficient thickness and the holes 32 must be positioned close enough to the partition plate 31. If these conditions are met, the uplifted walls at points 51 on the holes 32 form an inherent, integral bead lock 45 around the partition plate 31. This bead lock 45 is automatically formed as the holes 32 are worked.

The muffler system is used by constructing the muffler as described above and installing it on a Cessena 185 or similar aircraft. Once in place, the muffler operates automatically.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A muffler system for a aircraft having dual exhaust manifolds for discharging an exhaust gas comprising:

a) An outer housing;

b) a pair of oppositely disposed inlet ports, fixedly attached to said outer housing;

c) an exhaust gas conduit, being fixedly installed within said outer housing, said exhaust gas conduit having two ends, the two ends being fixedly attached to said pair of inlet ports, and an internal partition plate, fixedly installed therein, said exhaust gas conduit further having a plurality of holes formed wherein such that the exhaust gas is fed into said exhaust gas conduit from the pair of oppositely disposed inlet ports and said exhaust gas is then discharged through said plurality of holes, said exhaust gas conduit further including a cylindrical wall, having an outer surface, such that said plurality of holes penetrate said cylindrical wall and further such that said plurality of holes is formed such that the cylindrical wall of said exhaust gas conduit is raised upward above the outer surface of said cylindrical wall for each hole at a point in those holes closest to the pair of inlet ports, and the cylindrical wall of said exhaust gas conduit is depressed downward below the outer surface of said cylindrical wall, for each perforation, at a point in each perforation closest to the internal partition plate; and d) an exhaust port, fixedly attached to said outer housing for discharging said exhaust gas from said muffler system.

2. The muffler system of claim 1 further comprising a means for removably connecting said pair of inlet ports to said dual exhaust manifolds.

3. A muffler system for aircraft having dual exhaust manifolds and having outer housing; a pair of oppositely disposed inlet ports, fixedly attached to said outer housing, and an exhaust port wherein the improvement comprises:

a) an exhaust gas conduit, being fixedly installed within said outer housing, said exhaust gas conduit having two ends, the two ends being fixedly attached to said pair of inlet ports, and an internal partition plate, fixedly installed therein, said exhaust gas conduit further having a plurality of holes formed therein, and a cylindrical wall, having an outer surface, such that said plurality of holes penetrate said cylindrical wall and further such that said plurality of holes is formed such that the cylindrical wall of said exhaust gas conduit is raised upward above the outer surface of said cylindrical wall for each hole at a point in those holes being closest to each inlet port, and the cylindrical wall of said exhaust gas conduit downward below the outer surface of said cylindrical wall, for each hole at a point in those holes being closest to the internal partition plate, such that exhaust gas is fed into said exhaust gas conduit from the pair of oppositely disposed inlet ports and said exhaust gas is then discharged through said plurality of holes.

4. The muffler system of claim 3 further comprising a means for removably connecting said pair of inlet ports to said dual exhaust manifolds.

* * * * *